United States Patent [19]

Hightower

[11] Patent Number: 4,953,465

[45] Date of Patent: Sep. 4, 1990

[54] FLEXIBLE MINE CASE

[75] Inventor: Ralph E. Hightower, Silver Spring, Md.

[73] Assignee: The United States of America as represented by the Secretary of the Navy, Washington, D.C.

[21] Appl. No.: 320,578

[22] Filed: Oct. 31, 1963

[51] Int. Cl.[5] ..... F42B 22/00

[52] U.S. Cl. ..... 102/406

[58] Field of Search ..... 102/8-10, 102/54, 406, 407

[56] References Cited

U.S. PATENT DOCUMENTS 2,923,237 2/1960 Bleikamp, Jr. ..... 102/429

3,110,262 11/1963 West ..... 102/399

3,151,555 10/1964 Sellman ..... 102/416

3,194,158 7/1965 Paul, Jr. ..... 102/406

*Primary Examiner*—Stephen C. Bentley

*Attorney, Agent, or Firm*—Kenneth E. Walden

[57] ABSTRACT

A mine has a flexible casing which can be fabricated in much the same way that a tubeless tire of modern construction is made. The mine case when uninflated is flexible and capable of being folded into a considerably smaller space than that occupied by a rigid case thus facilitating ease of shipment, but when loaded and inflated it is rigid. Being a collapsible vessel, however, the flexible mine case loses its identity as a straight cylindrical form when planted underwater, and becomes hard to distinguish from rocks, sponge, coral, or other bottom or sea growths.

11 Claims, 2 Drawing Sheets

FLEXIBLE MINE CASE

The invention described herein may be manufactured and used by or for the Government of the United States of America for governmental purposes without the payment of any royalties thereon or therefor.

The present invention relates to a mine and more particularly to improvements in the construction of mine casings.

More specifically the invention contemplates the provision of a new and improved flexible mine case assembly suitable for use with a magnetic controlled firing mechanism and constructed of non-magnetic material preferably made up from multiple layers of fabric and rubber.

In recent years the design of influence fired mines has progressed to a point where it has become profitable for countermeasuring forces to hunt mines and destroy them one at a time rather than make use of the older method of area sweeping. This change in tactics has arisen from the flexibility inherent in many of the new designs, which vastly restricts previous techniques utilized by the countermeasure forces. Consequently there has been a resultant great emphasis on underwater short range sonar and the use of underwater television and acoustic devices all of which are aimed at identifying mine-like shapes. Several characteristics of present mines have become the keys that are used for such identification including, among others, the long straight lines representing the cylinders used for mine casings, hand holes where arming and safing devices are mounted and the readily recognizable geometry of conventional mine casings. Since the magnetic influence is the one most commonly used for firing mines of the type described, the firing mechanisms used therein often require the use of non-magnetic mine cases. Heretofore, non-magnetic materials such as nickel-manganese steel, aluminum and plastics have been used, but all of these are expensive and difficult to fabricate. Moreover, these mine cases have not been found to be entirely satisfactory under all conditions of service. Mines of this type, for example, must not be planted closer together than the range at which the charge of one mine, if exploded, will damage its neighbor mine because the exploding of charges near a mine is a recognized and well-known method of destroying mines once they have been located. Mine cases constructed from these rigid materials have definite limitations in this respect, two hundred feet usually being the minimum spacing required. Furthermore, it is the practice with present mines to provide a set of parts called a kit to allow the fleet personnel to practice with mines. These drill or practice mines are sometimes quite expensive and tedious to develop, but they are essential because stockpile mines are so costly that recovery and re-use of the materials therein would otherwise be necessary. In addition, it is necessary to provide a means for determining that the practice mine has actually fired during a drill. Another disadvantage of present mine cases is that they are usually shipped to advance bases in crates, fully loaded, which means that the hardware as well as the explosive material must be treated and handled with extreme care. It is noteworthy that a metal or plastic mine case, once loaded, can only be unloaded by melting the cast explosive out of the case. Furthermore, it has been the practice to coat a mine case inside with a hot-melt-liner before casting the explosive inside, and this of course is a time-consuming and expensive process.

In accordance with the present invention, the mine case retains all of the advantages of the prior mine casings of this general type and possesses none of the foregoing disadvantages. Briefly stated, the mine to be described herein has a flexible casing which can be fabricated in much the same way that a tubeless tire of modern construction is made. The mine case when uninflated is flexible and capable of being folded into a considerably smaller space than that occupied by a rigid case thus facilitating ease of shipment, but when loaded and inflated it is rigid. Being a collapsible vessel, however, the flexible mine case loses its identity as a straight cylindrical form when planted underwater, and becomes hard to distinguish from rocks, sponge, coral, or other bottom or sea growths.

Accordingly, in view of the foregoing, it may be stated that the broad objective of the present invention is to provide a new and improved non-magnetic mine case which is so constructed that when in use it will present a non-mine-like appearance so that even the identification of such as being a mine becomes a particularly difficult task.

A more specific object of the invention is to provide a flexible, non-magnetic mine case which disguises itself in the water by losing the identity of a recognizable geometry or configuration as exhibited by conventional mine casings.

Another object of the invention is to provide a flexible, non-magnetic mine case having rigid characteristics when loaded and inflated.

Another object of the invention is to provide a flexible, non-magnetic mine case which can be used in a wide variety of ways and is provided with shock-mitigating nose boot means adapting the mine case for launching from an aircraft.

Still another object of the invention is to provide a new and improved mine case which is inexpensive, easy to ship and store, simple to assemble, and which readily disguises itself once planted in the water.

Still other objects and advantages of the invention will be readily appreciated as the same becomes better understood by reference to the following detailed description thereof when considered in connection with the accompanying drawings wherein.

Figure 1:
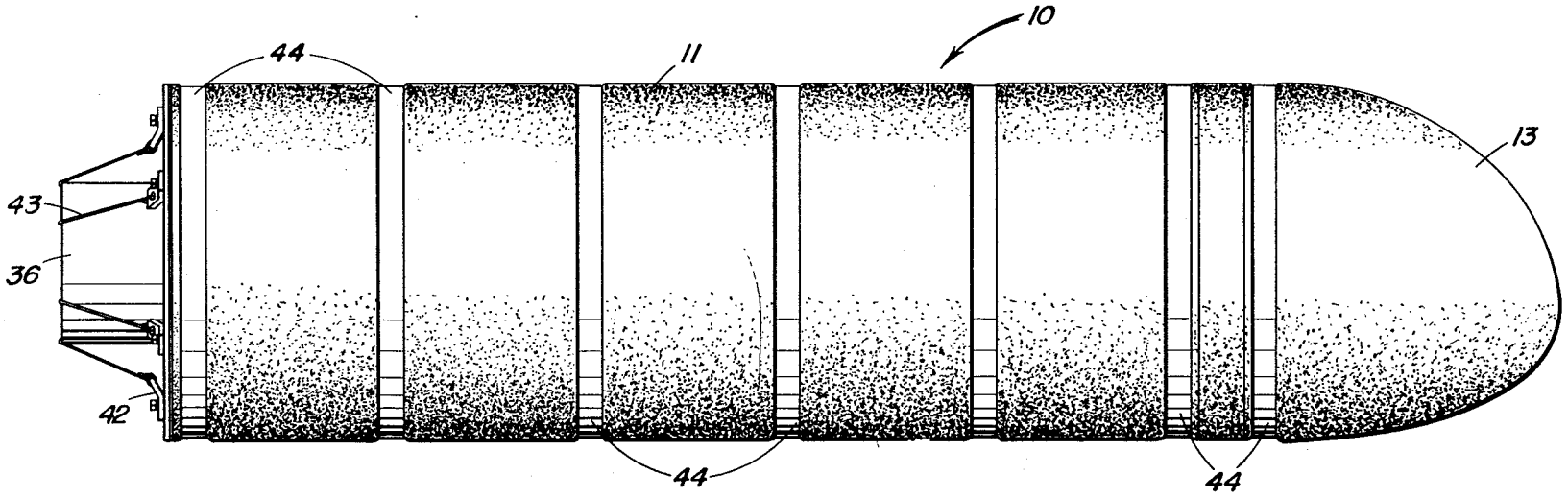
FIG. 1 is a plan view of a mine according to a preferred embodiment of the invention.

Referring now to the drawings wherein like numerals indicate like parts throughout the several views, and more particularly to FIG. 1, the reference numeral 10 generally indicates a typical mine embodying the invention and preferably formed with an elongated cylindrical casing 11 enclosing an explosive chamber 12, an ogive nose boot 13 fixed at one end of the casing and a bulkhead 14 closing the other end of the casing. The casing 11 is flexible and is constructed in accordance with the well-known techniques of tire manufacture being fabricated from multiple layers of tire cord material such as, for example, Tyrex, Rayon or Nylon Cord, impregnated with rubber, plastic or synthetic rubber to make a homogeneous, air-tight, strong, and dimensionally stable structure having a flanged area or bead 15 formed about the circumference of each end thereof. The beads 15 contain a strengthening ring member 16 made, for example, from phosphor bronze or brass wire. The ends of casing 11 are closed by similar bulkheads 14 and 17 in the same manner as a tire is fastened to a rim of an automobile wheel.

Figure 3:
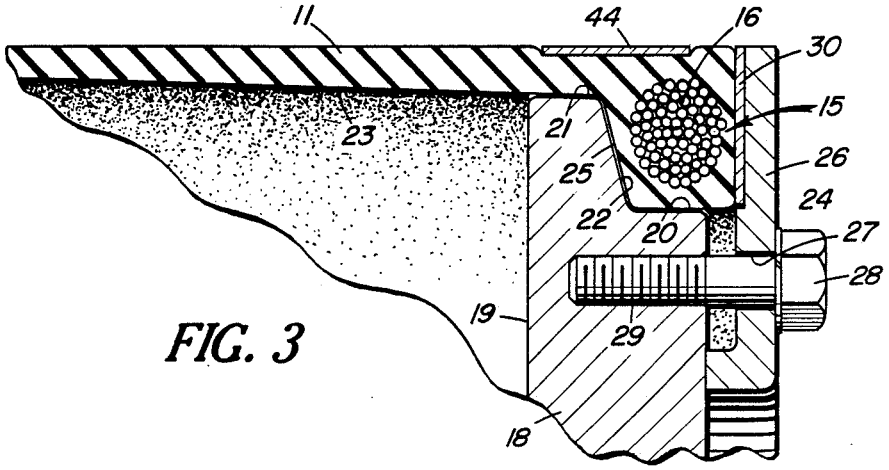
FIG. 3 is a partial plan view of an end closure of the flexible mine case.

As more clearly shown in FIG. 3, each of the bulkheads 14 and 17 is substantially disc-shaped and so formed that the diameter of its outer surface 18 is smaller than the diameter of its inner surface 19, and the peripheral wall thereof is made up of wall sections 20 and 21 extending substantially perpendicularly from surfaces 18 and 19 and coupled by an intermediate tapered shoulder 22. The inner and outer surface diameters, respectively, are determined in accordance with the internal diameter of the casing 11 defined by the inner wall 23 thereof and the inner peripheral wall 24 of bead 15 such that when a bulkhead is inserted into an end of the casing 11, the shoulder 22 thereof abuts the tapered inner wall 25 at the juncture of the main casing body and the flanged portion or bead 15 in close contacting relationship therewith. The bulkheads 14 and 17 may be pressure molded fabric impregnated Bakelite or Micarta, for example, having smooth mold finishes, and are maintained in sealed relationship with the cylindrical casing 11 when inserted in the ends thereof by flat annular clamping plates 26 positioned thereon around the circumference of the outer surface 18 of each bulkhead. Each clamping plate 26 is provided with a plurality of spaced holes 27 arranged in a circle about the inner periphery thereof, through which pass bolts 28 for threadably engaging apertures 29 in the outer surface 18 of the respective bulkhead. Bolts 28 draw the bulkheads tightly against their respective beads 15, compressing the bead so that the rubber coating thereon achieves the gasketing required to insure the water tight integrity of the system. A brass ring gasket 30 may also be utilized and is secured between each bead 15 and clamping plate 26.

Figure 2:
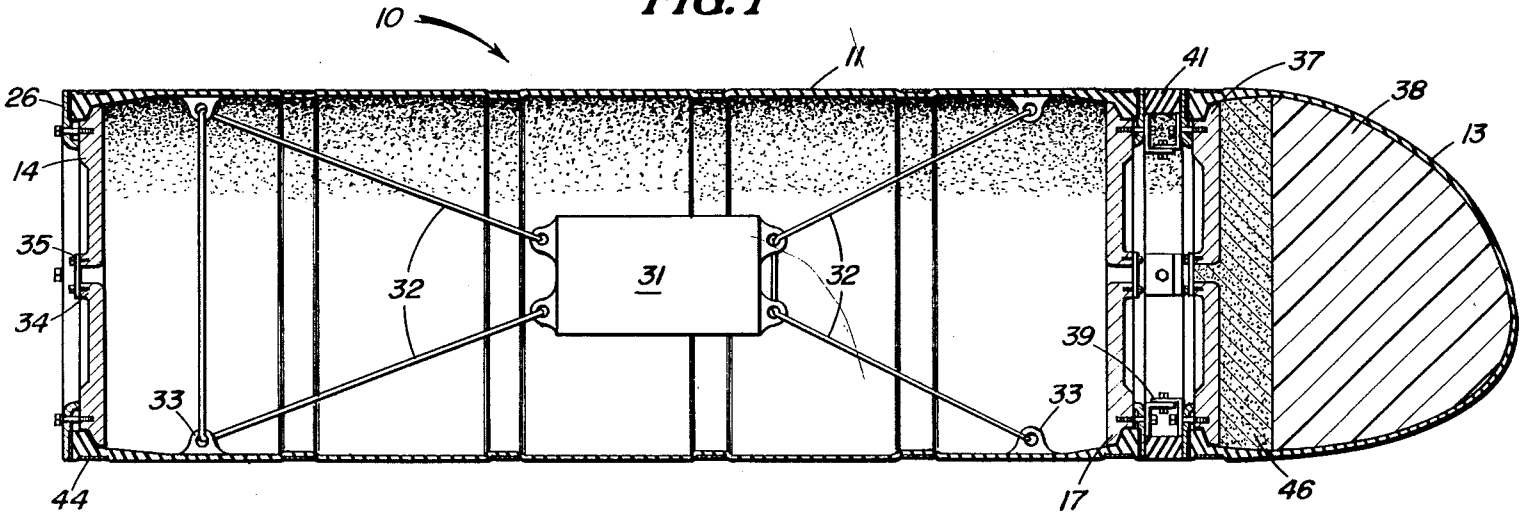
FIG. 2 is a side elevational view of the nose boot, a rubber fairing insert, the flexible case body, and an end closure, partly in section, of a mine assembly according to the invention.

Referring now to FIG. 2, an instrument and battery container generally indicated by the reference character 31 is mounted and secured within the charge compartment 12 by woven nylon lines 32 fixed at one end to the container 31 and at the other end to fabric-rubber reinforced anchor points 33 integral with the inside of the mine case 11. It will further be seen that each bulkhead is provided with an open boss 34 through which access to the interior of the mine case or nose boot is possible when the bulkhead is installed. This opening 34 may be used to house an arming and safing device (not shown) to "top off" the explosive charge used to fill the mine case or to fill the nose boot after the bulkhead is installed, or to provide a center-line positioning stud when a parachute pack or such is attached to the mine case. The opening may be sealed by a blanking plate 35 when so desired.

If the mine is to be adapted for planting from an aircraft, the ogive, shock mitigating nose boot 13 and tail fins with flight gear 36 may be attached to the casing 11 to complete the shape facilitating trajectory through the air and providing the desirable erratic under-water trajectory after water entry. Nose boot 13 is of the same tire construction as the cylindrical mine case and sealing thereof is accomplished in the same fashion, namely by the bead-bulkhead detail already described. Before placing bulkhead 37 in the nose boot 13, however, a conforming section 38 of Styrofoam is inserted. Bulkhead 37 is then attached to the boot 13 in sealed relationship therewith, and the void in the boot is filled through opening 34 with melted rosin, sulphur or other crystalline, dense material 46. Right angle lugs 39, having apertures 40 in each face thereof, are placed under bolts 28 on bulkheads 17 and 37 of the casing 11 and nose boot 13, respectively, for mechanically connecting the boot to the casing, as shown in detail in FIG. 2. A simple flat rubberized extensible girdle 41 of seamless construction closes the opening between the two sections and provides a fairing function as well. Parachute pack 36 (FIG. 1) is connected to bulkhead 14 of casing 11 in the same manner, except for obtuse-angle lugs 42 which provide a more suitable fastening means for lines 43 of the pack.

In preparing the mine for operation, granular explosive is loaded into casing 11 to fully occupy the space inside the mine and support the instrument container 31 therein, and air pressure is then applied inside the closed cylinder. The feature of flexibility would allow the mine case when so pressurized to assume a non-cylindrical shape during loading, but this type of distortion is prevented by circular strap bands 44 such as, for example, bronze strap bands, which may be applied with standard packaging hand tools at spaced intervals along the mine case length. A specified length of strap band is designated and applied so that each hoop or band 44 is exactly the same circumference thereby maintaining the general cylindrical shape of casing 11. Slight bulging between the bands at pressurization is relieved once the mine is exposed to its expected sea water depth. There the sea pressure is greater than the pressure within the casing, causing the shape of the flexible casing to be distorted into a grotesque, non-mine-like appearance and making detection by the usual mine locating devices extremely difficult. Since metal hoops 44 will normally provide an ideal reflecting surface for mine hunting sonar, a tread of rubber may be easily bonded to the mine case after assembly. The tread design preferably would be a medium soft tread with holes penetrating the surface but not extending through the tread rubber.

Figure 4:
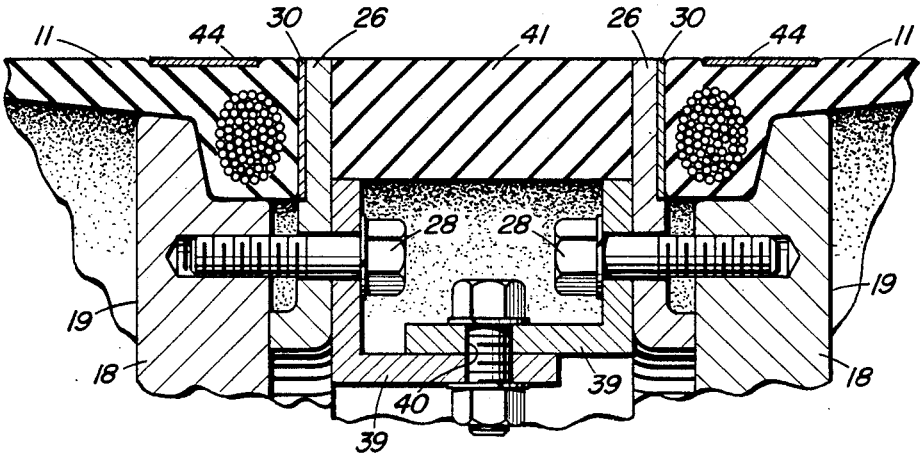
FIG. 4 is an enlarged plan view of the connection between the nose cone and the main casing body, including the lugs and elastic insert.
Figure 5:
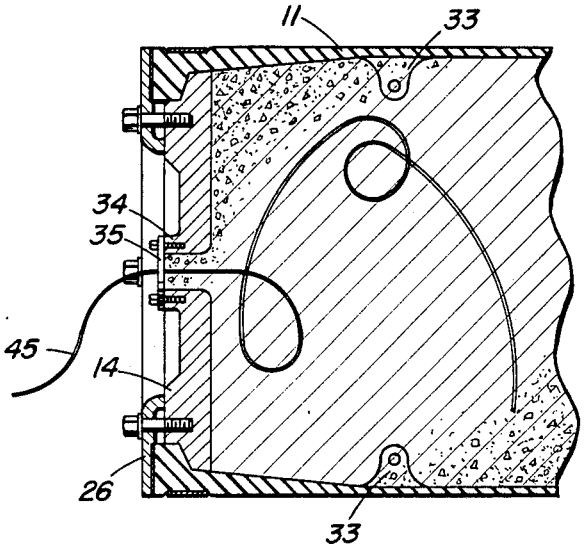
FIG. 5 is a sectional view of the flexible mine case body.

The configuration heretofore described is appropriate for a ground mine. Other applications of the invention are contemplated however, such as, for example, moored mines and drill mines. In the event the mine case is used as a moored mine, a lighter charge of explosive can be accommodated, leaving the mine with a given amount of positive buoyancy. In those cases where all the space is not to be filled with explosive, a mixture of granular explosive and granulated Styrofoam Vermiculite or other light aggregate may be used. If added weight is needed, sand may be added to the explosive and Styrofoam mixture to give the completely filled mine case a specific density of load. On the other hand, if the mine case is used as a drill or practice mine, it may be loaded with a mixture of a black powder charge and a light aggregate and primed by a length of detonating fuze which is initiated by an arming and safing device. A mixture of one part by volume of spherohexagonal Naval rifle powder to three parts granulated Styrofoam and 50 feet of Primacord has been found to be a satisfactory arrangement for this purpose. The detonating fuze 45 (FIG. 4) is coiled lazily throughout the explosive mixture to insure complete ignition of the black powder. When actuated in the depths below the surface that is normal for its use, a vast amount of smoke occurs, the water surface over the mine is disturbed and an exploding bubble may even be manifested on the surface seconds after the explosion, all of which affords more than sufficient evidence on the surface of the fact that the practice mine has actually exploded. Since the flexible mine casing construction of this invention is so inexpensive, recovery of the practice mine is unnecessary, thereby eliminating any need for the separate drill mine kit that has been required with mines in the past.

Briefly stated in summary, the present invention contemplates the provision of a flexible, non-magnetic mine casing preferably constructed of multiple layers of tire cord impregnated with rubber, plastic, synthetic rubber or the like to provide a homogeneous, air-tight structure which is inexpensive, easy to ship and store, simple to assemble, and the detection of which by present mine locators is made unusually difficult because of the distorting effect that sea pressure has upon its shape when planted underwater so that it no longer possesses a recognizable geometry or configuration as exhibited by conventional mine casings in the past. Moreover, a mine made in accordance with the provisions of the present invention may be used in a wide variety of ways such, for example, as a moored mine, a bottom mine or a drill mine which may be launched from the air or from the water, while yet maintaining incorporated therein all the desirable features set forth above.

Obviously many modifications and variations of the present invention are possible in the light of the above teachings. It is therefore to be understood that within the scope of the appended claims the invention may be practiced otherwise than as specifically described.

What is claimed as new and desired to be secured by Letters Patent of the United States is:

1. In a marine mine, a casing composed almost entirely of an outermost flexible, non-magnetic material and having at least one opening therein through which said casing may be loaded with an explosive charge and means for detonating said charge, means for sealedly closing said opening, and reinforcing means secured externally to said casing for substantially maintaining the casing in a given general configuration when supplied with air under pressure, whereby said loaded casing retains said general configuration when thereafter inflated to a predetermined pressure but is distorted when planted underwater at depths where the sea pressure is greater than said predetermined pressure to lose said general configuration and thereby disguise its identity as a mine.

2. In a marine mine, an elongated tubular casing composed of a flexible, non-magnetic material, closure means for sealedly closing the ends of said casing, at least one of said closure means having an opening therein for loading said casing with an explosive and detonating means therefor, means for sealedly closing said opening, and a plurality of metallic strap bands encircling said tubular casing and positioned thereon in spaced relationship along the length thereof for substantially maintaining the casing in a given general configuration during the loading thereof, whereby said loaded casing retains said general configuration when thereafter inflated to a predetermined pressure but is distorted when planted underwater at depths where the sea pressure is greater than said predetermined pressure to lose said general configuration and thereby disguise its identity as a mine.

3. A mine according to claim 2 wherein said tubular casing includes an integral circumferential flange at each end thereof and extending inwardly toward the longitudinal axis of the casing, said flanges cooperating with said end closure means to effectively seal the open ends of said casing.

4. A mine according to claim 2 wherein said flexible, non-magnetic material is rubber having at least one layer of a synthetic fabric embedded therein.

5. A mine according to claim 2 wherein said flexible, non-magnetic material is rubber having multiple layers of a synthetic fabric embedded therein.

6. A mine according to claim 5 wherein said synthetic fabric is Tyrex.

7. A mine according to claim 5 wherein said synthetic fabric is Nylon.

8. A mine according to claim 5 wherein said synthetic fabric is Rayon.

9. An underwater mine assembly comprising a cylindrical casing composed of a flexible, non-magnetic material defining an explosion chamber and having at least one opening therein, a quantity of granular explosive material substantially filling said explosion chamber, means for detonating said explosive material supported within said explosion chamber, means for inflating said casing with air under pressure and thereafter sealedly closing said opening, an ogive, shock-mitigating nose cone, lug means fixed to each of said casing and said nose cone, means for interlocking said casing lug means and said nose cone lug means and thereby fixedly securing said nose cone to said casing, and reinforcing means including a plurality of spaced strap bands encircling said casing for substantially maintaining the casing configuration when inflated to a predetermined pressure but permitting the distortion thereof when planted underwater at depths where the sea pressure is greater than said predetermined pressure.

10. A mine according to claim 9 wherein said flexible, non-magnetic material is rubber having multiple layers of synthetic fabric embedded therein.

11. A marine mine comprising a pressurized casing composed almost entirely of a flexible, non-magnetic material, detonator means supported within said casing, a high explosive carried inside said casing, and reinforcing means secured to the exterior surface of said casing for normally maintaining the pressurized casing in a given configuration, whereby when said casing is planted underwater at depths where the sea pressure is greater than the pressure inside the casing, the configuration of the casing is distorted in such a manner as to disguise its identity as a mine object.

* * * * *